US008820807B2

(12) United States Patent
Allen

(10) Patent No.: US 8,820,807 B2
(45) Date of Patent: Sep. 2, 2014

(54) CONTAINER CARRYING APPARATUSES AND RELATED METHODS

(71) Applicant: Benjamin Lee Allen, Kearney, NE (US)

(72) Inventor: Benjamin Lee Allen, Kearney, NE (US)

( * ) Notice: Subject to any disclaimer, the term of this patent is extended or adjusted under 35 U.S.C. 154(b) by 0 days.

(21) Appl. No.: 13/935,316

(22) Filed: Jul. 3, 2013

(65) Prior Publication Data

US 2014/0008926 A1 Jan. 9, 2014

Related U.S. Application Data

(60) Provisional application No. 61/667,842, filed on Jul. 3, 2012.

(51) Int. Cl.
*B66C 1/16* (2006.01)

(52) U.S. Cl.
USPC ..... 294/67.1; 294/68.3

(58) Field of Classification Search
USPC ..... 294/32, 67.1, 67.4, 67.41, 68.1, 68.3, 294/167, 169, 173; 220/743
See application file for complete search history.

(56) References Cited

U.S. PATENT DOCUMENTS

| | | | | |
|---|---|---|---|---|
| 238,564 | A * | 3/1881 | Brown | 294/32 |
| 495,080 | A * | 4/1893 | Wilson | 220/6 |
| 642,171 | A * | 1/1900 | Suppes | 294/68.1 |
| 737,449 | A * | 8/1903 | McElhany | 294/68.22 |
| 909,715 | A * | 1/1909 | Troegeler | 220/8 |
| 983,473 | A * | 2/1911 | Barnes | 248/154 |
| 1,063,285 | A * | 6/1913 | Rice | 294/67.1 |
| 1,068,920 | A * | 7/1913 | Nielson | 294/32 |
| 1,091,908 | A | 3/1914 | Benners | |
| 1,353,282 | A * | 9/1920 | Shrauger | 294/169 |
| 1,678,988 | A * | 7/1928 | Maier | 47/71 |
| 2,774,510 | A | 12/1956 | Logan | |
| 3,844,460 | A | 10/1974 | Courtright | |
| 4,045,069 | A | 8/1977 | Fife | |
| 4,481,972 | A | 11/1984 | Stavlo | |
| 4,834,438 | A | 5/1989 | Haidet | |
| 5,228,821 | A | 7/1993 | Gleffe et al. | |
| 5,524,950 | A | 6/1996 | Erickson | |
| 7,997,213 | B1 | 8/2011 | Gauthier et al. | |
| 2001/0029698 | A1 | 10/2001 | Warmerdam et al. | |

FOREIGN PATENT DOCUMENTS

| | | |
|---|---|---|
| CN | 201445499 | 5/2010 |
| DE | 29824998 | 5/2004 |

* cited by examiner

*Primary Examiner* — Dean Kramer
(74) *Attorney, Agent, or Firm* — Brient Globerman LLC

(57) ABSTRACT

A carrier for hoisting a load from a first height to a second height. The carrier comprises a substantially bucket-shaped frame configured to support a load while the load is being hoisted from the first height to the second height and a bail for affixing a hoisting mechanism in order to enable the hoisting. The frame includes a base, an upper portion, and a plurality of vertical supports that extend between the base and the upper potion. The base comprises at least one lower support that defines a support surface for supporting the load, which may include a standard five gallon bucket.

3 Claims, 6 Drawing Sheets

CONTAINER CARRYING APPARATUSES AND RELATED METHODS

CROSS REFERENCE TO RELATED APPLICATION

This application claims priority from U.S. Provisional Patent Application No. 61/667,842, filed Jul. 3, 2012, entitled "Container Carrying Apparatuses and Related Methods," which is hereby incorporated herein by reference in its entirety.

BACKGROUND

At construction sites, materials often need to be delivered from ground level to elevated working areas (e.g., working areas supported by scaffolding). Construction workers may mix cement, concrete, or plaster in five gallon plastic buckets, hook a rope to the bucket bail/handle, and hoist the bucket up to the elevated working area using a pulley system. Failure of bucket handles and resulting injuries have created a need for improved systems for hoisting such buckets and other materials as well as lowering construction debris, tools, and other items to and from elevated work platforms.

SUMMARY

A carrier, according to various embodiments, comprises a frame and a bail. In particular embodiments, the frame comprises a base, at least one vertical support, and an upper portion and defines an opening adjacent the upper portion that is sized to accommodate a substantially bucket-shaped object. In various embodiments, the bail is affixed adjacent the upper portion of the frame. In particular embodiments, the carrier is configured to allow a user to selectively place the substantially bucket-shaped object substantially within the carrier. In some embodiments, that base is configured to at least partially support the substantially bucket-shaped object when the substantially bucket-shaped object is substantially within the carrier. In particular embodiments, the carrier is adapted to allow the user to hoist the carrier and the substantially bucket-shaped object from a first height to a second height.

A method of transporting a substantially bucket-shaped object from a first height to a second height, according to various embodiments, comprises: (1) providing a carrier; (2) providing the substantially bucket-shaped object; (3) providing a hoisting mechanism; (4) placing the substantially bucket-shaped object within the carrier; (5) attaching the hoisting mechanism to the bail; and (6) using the hoisting mechanism to hoist the substantially bucket-shaped shaped object and the carrier from the first height to the second height. In particular embodiments, the carrier comprises a frame and a bail. In various embodiments, the frame comprises a substantially circular base, a substantially circular upper portion, and at least one vertical support extending between the base and the upper portion. In particular embodiments, the frame defines an opening adjacent the upper portion that is sized to accommodate the substantially bucket-shaped object. In particular embodiments, the bail is disposed adjacent the upper portion.

A carrier for hoisting a substantially bucket-shaped object, in various embodiments, comprises a substantially cylindrical frame and a bail. In particular embodiments, the frame comprises: (1) a substantially circular base comprising one or more lower supports defining a support surface for the substantially bucket-shaped object; (2) a substantially circular upper portion; and (3) a plurality of vertical supports that extend between the base and said upper portion that are substantially parallel to one another and disposed substantially evenly about a circumference of the base and said upper portion. In various embodiments, the bail has a first and a second end wherein the first end is disposed adjacent the frame's upper portion, and the second end is disposed adjacent the frame's upper portion in a location that is diametrically about the upper portion's circumference. In particular embodiments, the carrier is configured to enable a user to hoist the substantially bucket-shaped object from a first height to a second height by affixing a hoisting mechanism to the bail. In some embodiments, the carrier is configured to maintain the substantially bucket-shaped object within the frame while the user is hoisting the carrier.

BRIEF DESCRIPTION OF THE DRAWINGS

In the course of this description, reference will be made to the accompanying drawings, which are not necessarily drawn to scale, and wherein.

OVERVIEW

Figure 1:
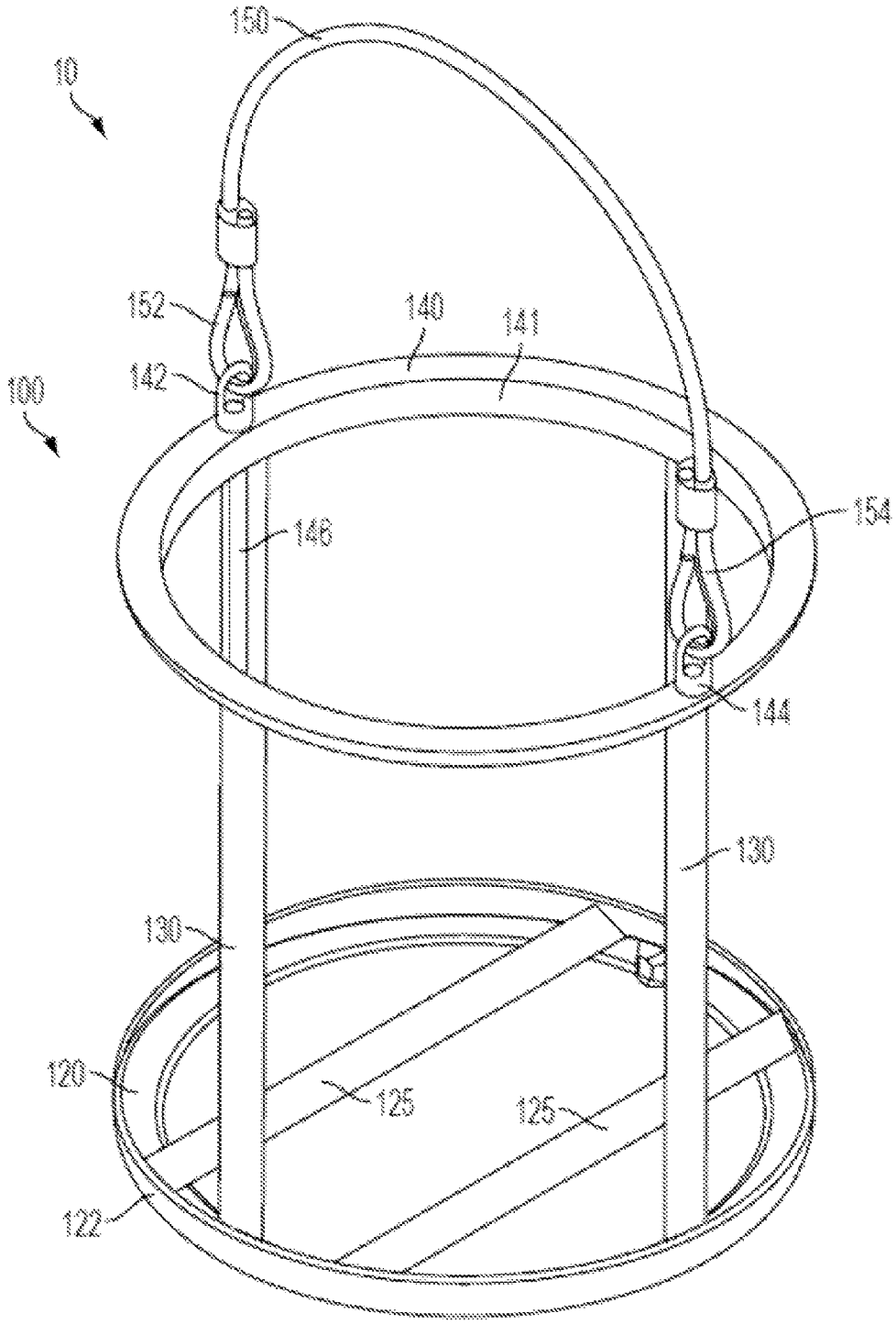
FIG. 1 is a perspective view of a carrier according to a particular embodiment.

As may be understood from FIG. 1, a carrier 10, according to a particular embodiment, includes a frame 100 that a bucket, pail or other carrier 10 can be placed in for hoisting. The frame 100 may be comprised of, for example, welded aluminum or steel and may be sufficiently strong to support the weight of a fully loaded bucket (e.g., a bucket full of cement or similar heavy material, or objects). The frame 100 also includes a bail 150 (e.g., handle portion), which may, for example, be made of a heavy cable. In order to use the carrier 10, a user may: (1) place a bucket, or similar object within the carrier 10; (2) tie or hook a rope or other hoisting mechanism to the carrier 10 (e.g., on the carrier's bail 150); and (3) hoist the carrier 10 and object using a pulley or similar hoisting mechanism. In particular embodiments, the enclosure is designed to allow a bucket to be taken out of or placed within the carrier 10 without unhooking the carrier 10 from the rope with which it is hoisted.

DETAILED DESCRIPTION OF VARIOUS EMBODIMENTS

In various embodiments, such as the embodiment shown in FIG. 1, a carrier 10 comprises a frame 100 and a bail 150. In particular embodiments, the frame 100 comprises a base 120, at least one vertical support 130, and an upper portion 140.

Base

In particular embodiments, the carrier's frame 100 comprises a substantially circular (e.g., circular) base 120. In various embodiments, the substantially circular (e.g., circular) base 120 defines a substantially circular opening whose center is substantially centered (e.g., centered) with respect to the substantially circular base 120. In various embodiments, the substantially circular (e.g., circular) base 120 has a diameter that substantially corresponds to (e.g., corresponds to) the diameter of a lower portion of a typical five-gallon bucket. In particular embodiments, the substantially circular (e.g., circular) base 120 has a diameter that is between about 10 inches and about 16 inches. In a particular embodiment, the substantially circular (e.g., circular) base 120 has a diameter of about 14 inches. In another embodiment, the substantially circular (e.g., circular) base 120 has a diameter of about 13 inches.

In the embodiment shown in FIG. 1, the base 120 comprises a substantially circular (e.g., circular) hoop portion 122 that extends substantially perpendicularly (e.g., perpendicularly) upward from an outer portion of the base 120. In various embodiments, the base 120 and hoop portion 122 are affixed using any suitable fastening technique (e.g., welding, etc.). In other embodiments, the base 120 and hoop portion 122 are substantially integrally formed (e.g., integrally formed). As shown in FIG. 1, the base 120 and hoop portion 122 form a substantially L-shaped (e.g., L-shaped), substantially circular (e.g., circular) frame. In particular embodiments, the base 120 and hoop portion 122 form a sufficiently sturdy frame for supporting a load (e.g., a bucket) in the carrier 10. In various embodiments, the base 120 comprises any suitable material having sufficient strength to support concrete, construction debris, tools, etc. within the carrier 10 (e.g., such as steel, aluminum, etc.)

In particular embodiments, the base 120 further comprises at least one lower support 125 that extends substantially secant (e.g., secant) to the substantially circular (e.g., circular) base 120 between two portions of the base 120 about the base's circumference. In other embodiments, the lower supports 125 may extend radially across the base 120 to form a support surface adjacent the base 120 for supporting a load (e.g., the lower supports 125 extend between two points about the base's circumference that are substantially diametrically opposed). In some embodiments, such as the embodiment shown in FIG. 1, the base comprises two lower supports 125 that run substantially secant to the substantially circular (e.g., circular) base 120. In such embodiments, the two lower supports 125 may be substantially parallel (e.g., parallel) to one another.

In particular embodiments, the lower supports 25 may be substantially planar (e.g., planar). In other embodiments, such as the embodiment shown in FIG. 1, the lower supports may be substantially V-shaped (e.g., V-shaped). In still other embodiments, the lower supports 125 may have any other suitable profile or configuration for supporting a load (e.g., may be substantially cylindrical, substantially rectangular, etc.). In various embodiments, the base 120 may comprise a plurality of lower supports that are substantially secant (e.g., secant) to the substantially circular (e.g., circular) base 120 (e.g., three lower supports, four lower supports, etc.). In other embodiments, the frame 100 may include any number of lower supports 125 in any suitable arrangement for supporting an object within the frame 100 (e.g., a plurality of lower supports 125 in a lattice arrangement, a plurality of lower supports 125 in a checkerboard arrangement, etc.). In one embodiment, the base 120 comprises a substantially solid, single piece of material that may also serve as a lower support 125.

In various embodiments, the lower supports 125 define a support surface for supporting a load adjacent the carrier's base 120. In particular embodiments, the support surface defined by the lower supports 125 is substantially parallel (e.g., parallel) to a support surface while the carrier 10 is resting substantially upright on the support surface. In some embodiments, the support surface defined by the lower supports 125 is sufficiently flat to substantially stably (e.g., stably) support a substantially upright bucket (e.g., such as a standard five gallon bucket).

Figure 2:
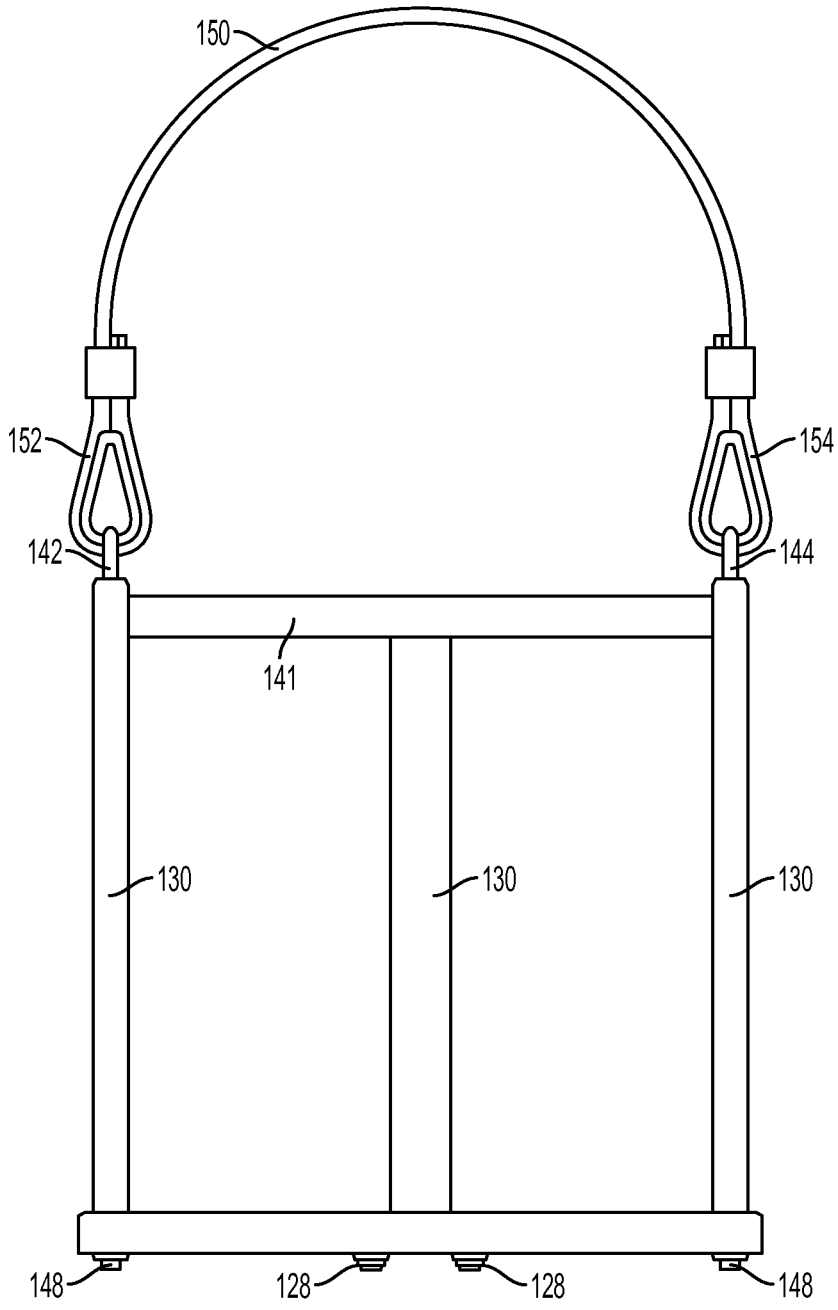
FIG. 2 is a side view of the carrier of FIG. 1.

In particular embodiments, the frame's base 120 may comprise a plurality of pieces of material affixed in any suitable manner to form the base 120 (e.g., using any suitable fasteners or welding techniques). Referring briefly to FIG. 2, in particular embodiments, portions of the frame's base 120 may be affixed and/or assembled using any suitable fastener 128 (e.g., such as a rivet, bolt, etc.). In other embodiments, the base 120 may comprise bolts or other fasteners 128, which may, for example, provide additional structural strength to the base.

In various embodiments, the carrier's base 120 may have a profile other than a circular profile. For example, in particular embodiments, the carrier's base may be substantially rectangular or have any other suitable profile (e.g., pentagonal, hexagonal, heptagonal, octagonal, etc). In particular embodiments, the carrier's base may be made of any suitable material (e.g., steel, titanium, aluminum, or any suitable alloy). In various embodiments, the frame's base 120 may include any number of lower supports 125 in any suitable arrangement.

Vertical Supports

In particular embodiments, the frame 100 further comprises at least one vertical support 130. In various embodiments, the at least one vertical support 130 extends substantially perpendicular to the plane of the carrier's base 120 between the carrier's base 120 and upper portion 140. In the embodiment shown in FIG. 1, the at least one vertical support 130 is substantially perpendicular (e.g., perpendicular) to a support surface when the carrier 10 is resting on the support surface in a substantially upright orientation.

In particular embodiments, such as the embodiment shown in FIG. 1, the carrier 10 comprises four vertical supports 130. In this embodiment, the vertical supports 130 are substantially evenly spaced (e.g., evenly spaced) about the circumference of the substantially circular (e.g., circular) base 20. In other embodiments, the carrier 10 may comprise a plurality of vertical supports 130. In various embodiments, each vertical support 130 may be substantially rectangular (e.g., rectangular) and substantially planar (e.g., planar). In other embodiments, the vertical supports 130 may be substantially V-shaped (e.g., V-shaped). In still other embodiments, the vertical supports may have any other suitable profile or geometry suitable for providing a structurally sturdy frame for the carrier 10 (e.g., cylindrical, etc.). In particular embodiments, the vertical supports 130 may be attached adjacent (e.g., to) the base 120 in any suitable manner (e.g., using suitable fasteners or welding techniques). In particular embodiments, the vertical supports 130 are affixed to the base's hoop portion 122 in any suitable manner.

In particular embodiments, the vertical supports 130 have a length that substantially corresponds to a height of a typical five-gallon bucket. In other embodiments, the vertical supports 130 have a length that is greater than a height of a typical five-gallon bucket. In various embodiments, the vertical supports 130 have a height of between about 12 and about 17 inches. In a particular embodiment, the vertical supports have a length that is between about 14 and about 15 inches. In one embodiment, the vertical supports have a length that is about 14.5 inches. In still another embodiment, the vertical supports have a length that is about 16 inches.

In some embodiments, the carrier 10 may include vertical supports 130 that are disposed other than perpendicularly with respect to the base (e.g., in a diagonal or crossing pattern about the circumference of the carrier 10. In still other embodiments, the vertical supports may have any suitable configuration for providing a substantially sturdy frame 100 for the carrier 10.

Upper Portion

In various embodiments, the frame 100 may comprise an upper portion 140 disposed adjacent an upper portion of the vertical supports 130. In particular embodiments, the upper portion 140 comprises a substantially circular (e.g., circular) frame. In various embodiments, the substantially circular (e.g., circular) upper portion 140 defines a substantially circular opening whose center is substantially centered (e.g., centered) on the substantially circular upper portion 140. In various embodiments, the upper portion 140 has a diameter that substantially corresponds to (e.g., is substantially the same as) the diameter of the base 120. In other embodiments, the upper portion 140 has a diameter that is greater than the diameter of the base 120. In still other embodiments, the upper portion 140 has a diameter that is less than the diameter of the base 120.

In various embodiments, the substantially circular upper portion 140 may have a diameter that substantially corresponds to (e.g., corresponds to) a diameter of a typical five-gallon bucket (e.g., a diameter of an upper or lower portion of a typical five-gallon bucket). In particular embodiments, the substantially circular upper portion 140 has a diameter that is between about 11 inches and about 16 inches. In a particular embodiment, the substantially circular upper portion 140 has a diameter of about 14 inches.

In particular embodiments, the frame 100 comprises an upper hoop portion 141 disposed adjacent the upper portion 140. In particular embodiments, the upper hoop portion 141 is substantially circular (e.g., circular) and extends substantially normal (e.g., normal) and downward from an inner portion of the circular upper portion 140. In various embodiments, the upper portion 140 and upper hoop portion 141 are affixed using any suitable fastening technique (e.g., welding, etc.). In other embodiments, the upper portion 140 and upper hoop portion 141 are substantially integrally formed (e.g., integrally formed). As shown in FIG. 1, the upper portion 140 and upper hoop portion 141 form a substantially L-shaped (e.g., L-shaped), substantially circular (e.g., circular) frame. In particular embodiments, the upper portion 140 and upper hoop portion 141 form a sufficiently sturdy frame for maintaining a load (e.g., a bucket) within the carrier's frame 100. In various embodiments, the upper portion 140 upper hoop portion 141 comprise any suitable material having sufficient strength to support concrete, construction debris, tools, etc. within the carrier 10 (e.g., such as steel, aluminum, etc.)

In particular embodiments, the plane of the substantially circular upper portion 140 is substantially parallel to the plane of the substantially circular base 120. In various embodiments, the carrier's base 120, vertical supports 130, and upper portion 140 form a substantially bucket-shaped frame (which may include, for example, a frame defining an interior that substantially conforms with the exterior of a bucket). In the embodiment shown in FIG. 1, the carrier's base 120, vertical supports 130, and upper portion 140 define a substantially cylindrical (e.g., cylindrical) frame 100.

Bail

Figure 3:
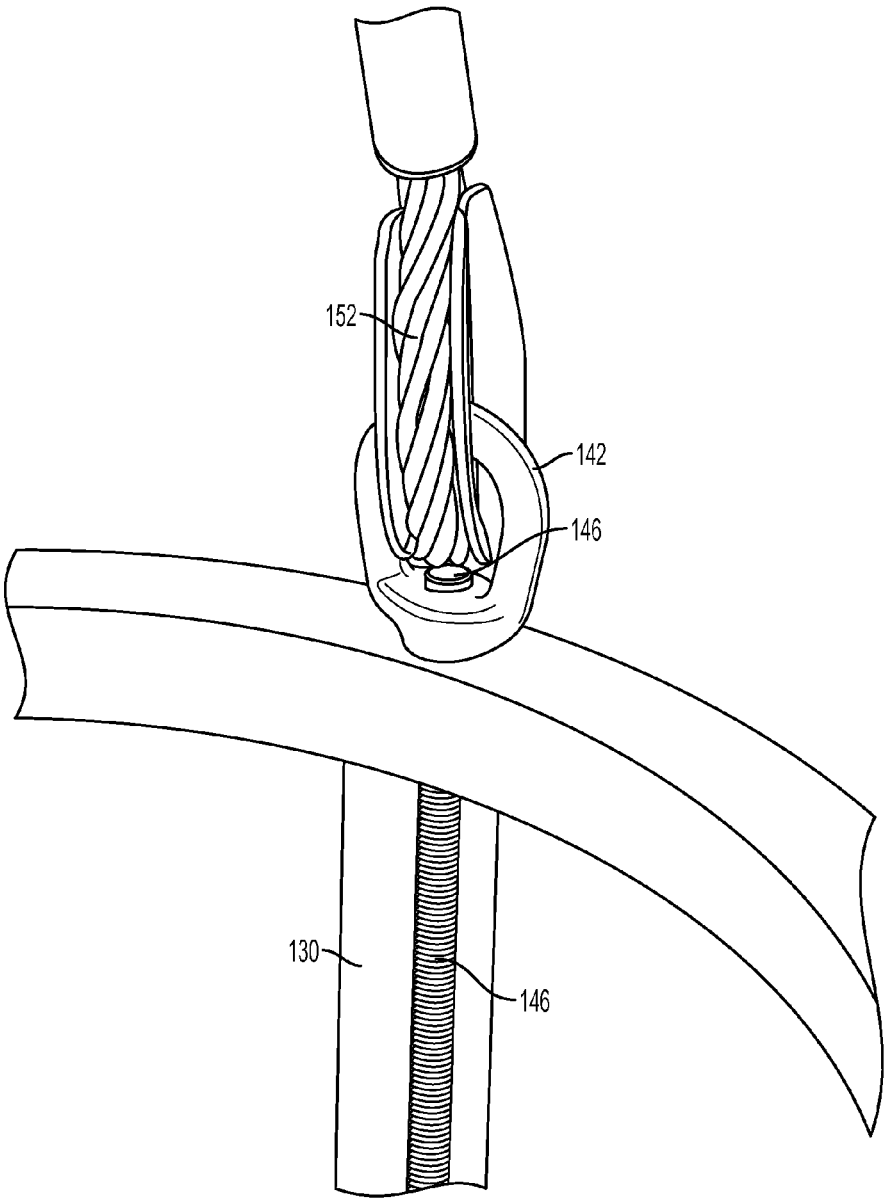
FIG. 3 is a detail view of a bail connection of the carrier of FIG. 1.

In particular embodiments, the carrier 10 comprises a bail 150 (e.g., a handle portion) attached (e.g., to) the frame's upper portion 140. In a particular embodiment, the bail extends between two points on a circumference of the upper portion 140 that are substantially diametrically opposed (e.g., diametrically opposed) from one another. In various embodiments, the bail 150 may be attached in any suitable manner (e.g., using suitable fasteners or welding). In particular embodiments, the bail 150 comprises a cable (e.g., a steel cable). As may be understood from FIGS. 1-3, the bail 150, in the embodiment shown in these figures, is supported about either end adjacent the carrier's upper portion 140 via an eye nuts 142, 144 which supports the bail's respective ends 152, 154. As shown in FIG. 3, the bail's end 152 may include any suitable loop for cooperating with the eye nut 142 in order to maintain the bail adjacent the carrier's upper portion 140. In some embodiments, the bail's end 152 may form a loop by folding an end portion of the bail cable over itself and affixing the bail cable's end to a portion of the bail cable that is spaced apart from the cable's end (e.g., using a suitable fastener).

In the embodiment shown in FIG. 3, the bail's end 152 comprises a loop that interlocks with the eye nut 142. As may be further understood from this figure, the eye nut 142 is attached (e.g., to) the carrier's upper portion 140 by screwing the eye nut 142 into a threaded rod 146. In the embodiment shown in FIGS. 1-3, the threaded rod 146 extends from the carrier's upper portion 140 to the carrier's base 120. In various embodiments, the threaded rod 146 is supported adjacent the carrier' base 120 via a bolt 148 or other suitable fastener as may be understood from FIG. 2. As shown in FIG. 1, the threaded rod 146 is disposed at least partially within a vertical support 130 (e.g., a substantially V-shaped vertical support 130). In other embodiments, the threaded rod 146 may be at least partially enclosed within a substantially cylindrical (e.g., cylindrical) vertical support.

Alternative Embodiments

Figure 4:
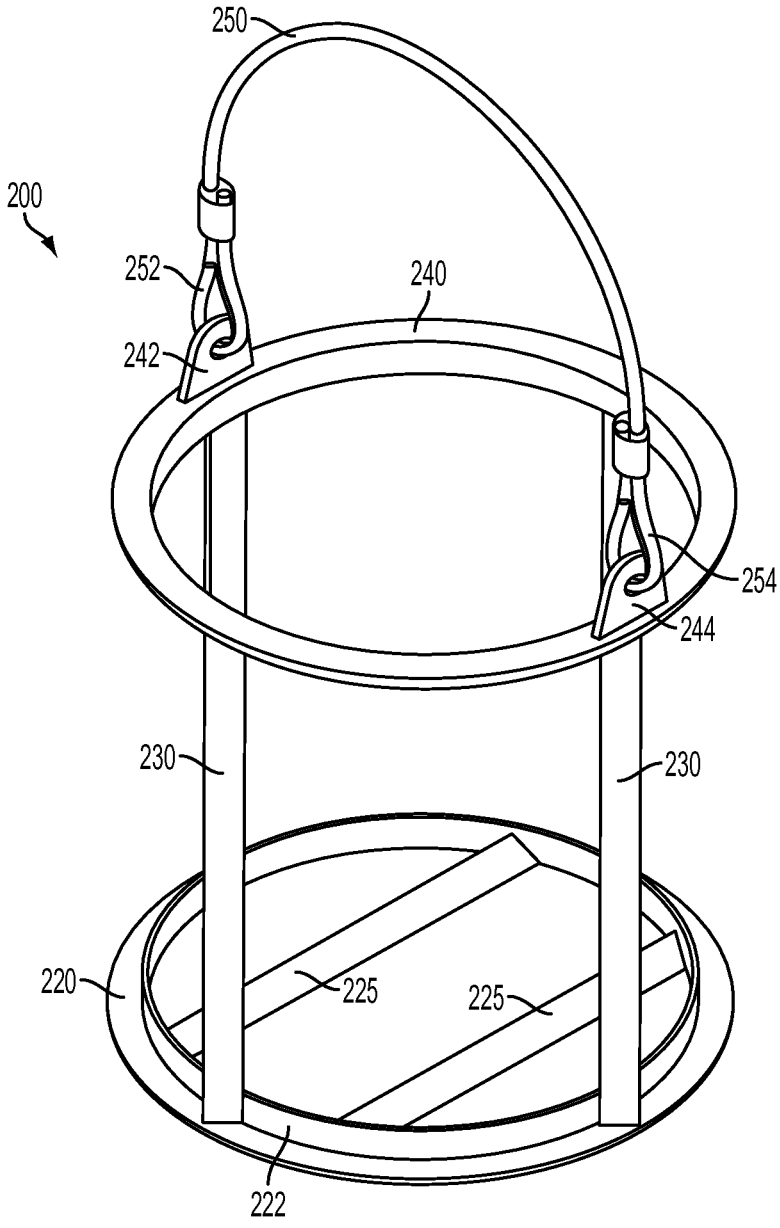
FIG. 4 is a perspective view of a carrier according to another embodiment.

Alternative embodiments of a carrier may include features which are similar to the embodiment shown in FIG. 1, and also include additional or altered features. FIG. 4 shows an alternative embodiment of a carrier. As shown in this Figure, the carrier includes an upper portion 240, a base 220, a plurality of vertical supports 230, and a bail 250. In this embodiment, the hoop portion 222 is disposed adjacent an interior edge of the substantially circular base 220 and the lower supports 225 are affixed to a portion of an interior of the hoop portion 222 (e.g., using any suitable fastener or welding technique). As may be understood from the embodiment shown in this figure, the carrier's frame 200 forms a substantially bucket-shaped (e.g., bucket shaped) carrier for supporting a load within the frame 200.

In various embodiments, the bail may be affixed adjacent a portion of the carrier other than the upper portion. For example, in particular embodiments, the bail's ends may be affixed adjacent any portion of the vertical supports. In a particular embodiments, the bail may be affixed (e.g., via the bail's ends) adjacent any portion of the carrier's frame located in an upper half of the substantially cylindrical frame when the carrier is in an upright position. In some embodiments, the bail's ends may be disposed adjacent the carrier's base. In other embodiments, the carrier may comprise a plurality of bails or other suitable features for enabling a user to attach a hoisting mechanism to the carrier (e.g., one or more hooks, one or more openings in the frame, etc.)

Exemplary Use

Figure 5:
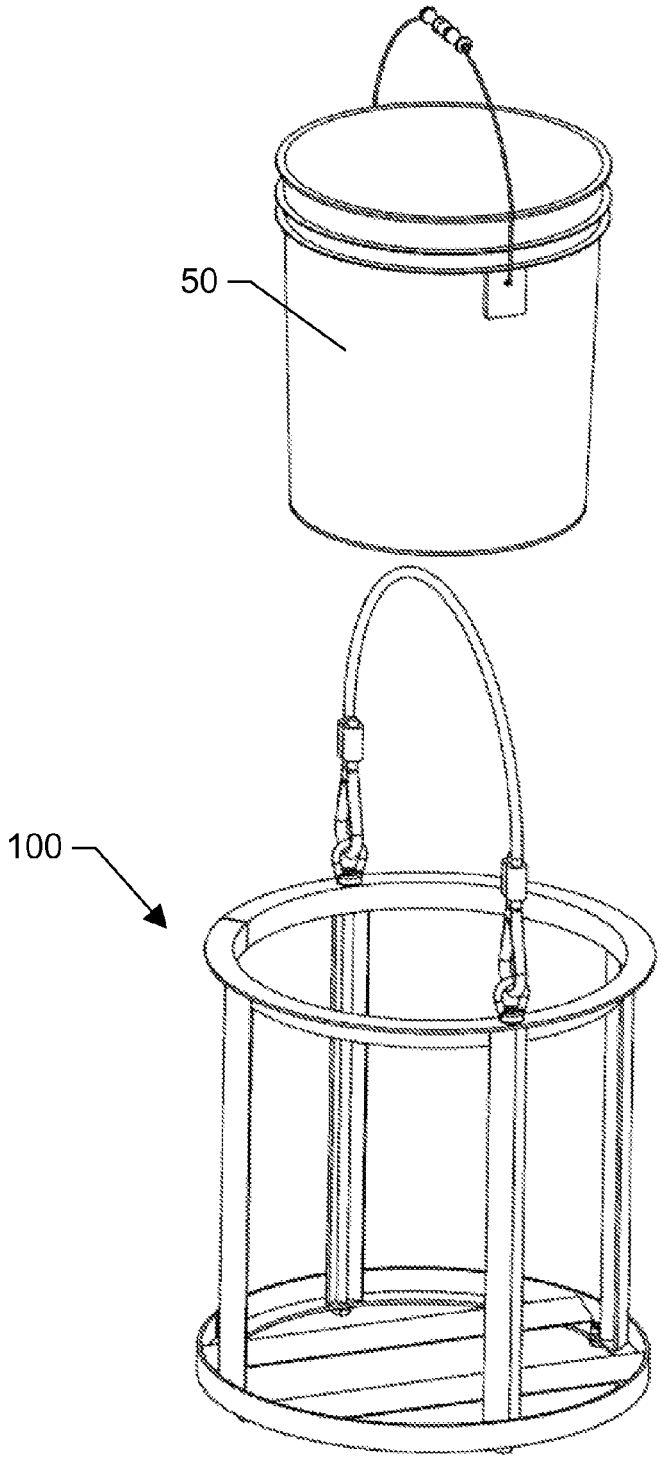
FIG. 5 is the carrier of FIG. 1 with a bucket.
Figure 6:
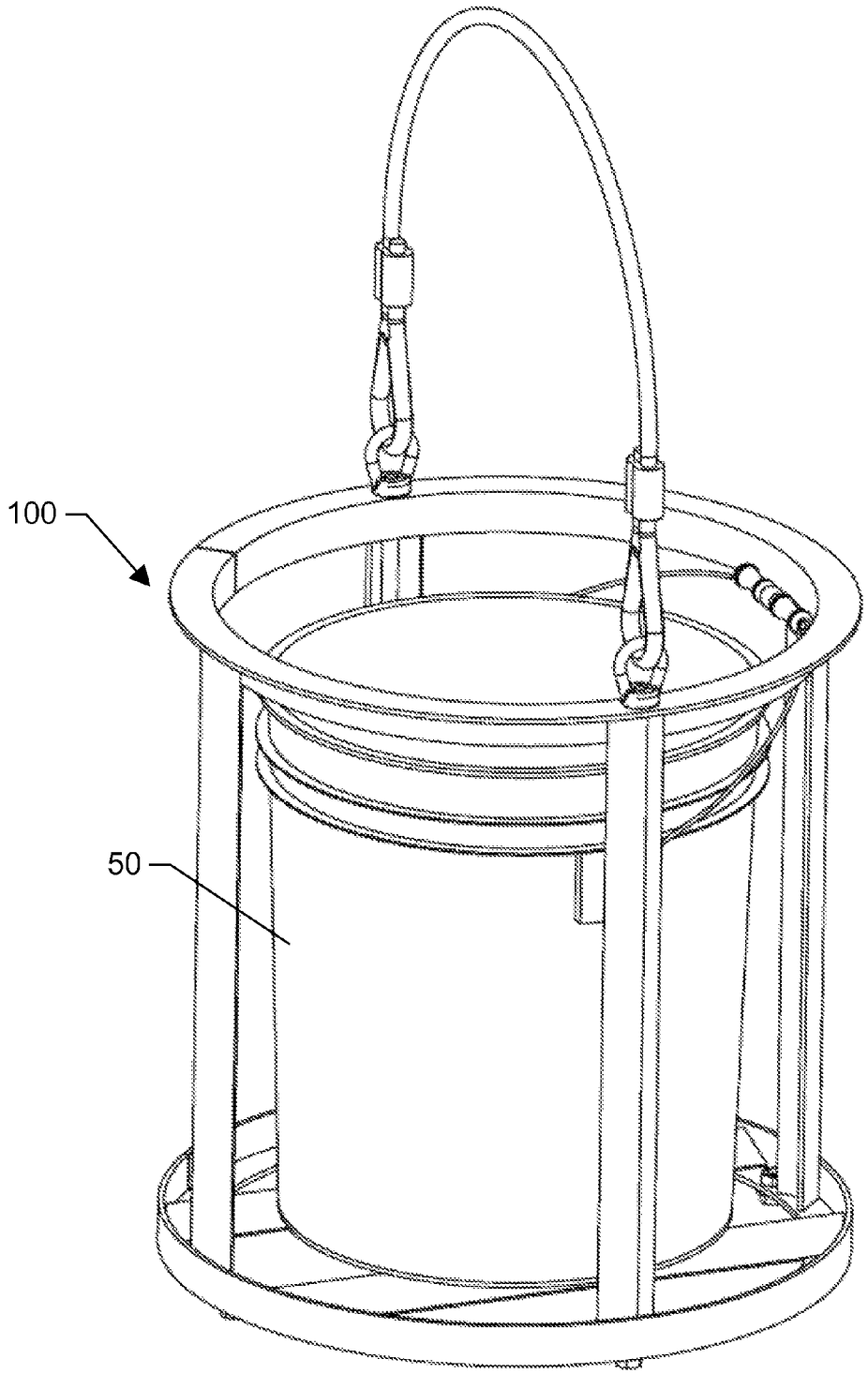
FIG. 6 is the carrier of FIG. 1 with a bucket supported within the carrier's frame.

In various embodiments, as shown in FIGS. 5 and 6, the carrier 10 is adapted to allow a user to selectively place an object or objects (e.g., a bucket, or other object) within the carrier 10 for the purpose of hoisting the carrier 10 along with the object or objects within the carrier 10 to an elevated area. As may be understood from FIGS. 5 and 6, a user may place the object within the carrier's frame 100 (e.g., by placing an object such as a bucket 50 into the opening of the carrier's upper portion such that the object rests on the carrier's base (e.g., the object is supported by the carrier's base's lower supports)). When the user has placed the object within the carrier 10, the object may be substantially fully contained (e.g., fully contained) within the carrier's frame. In particular embodiments, the carrier may be adapted to allow a user to selectively insert and remove objects into and out of the carrier without removing the carrier's bail.

In a particular embodiment, the interior shape of the carrier's frame is adapted to substantially conform to the exterior shape of a bucket so that when the user places a bucket into the carrier, the bucket is prevented from moving laterally within the carrier as shown in FIG. 6. In particular embodiments, the carrier is substantially the same height as, and has substantially the same radius as, a standard bucket.

Once the user has placed an object within the carrier, the user may attach a suitable hoisting mechanism (e.g., a rope or other suitable hoisting mechanism) to the carrier's bail (e.g., by tying the hoisting mechanism to the bail, hooking the hoisting mechanism on the bail, or attaching the hoisting mechanism to the bail in any manner suitable to allow the hoisting mechanism to remain attached to the bail while hoisting the carrier).

The user may then hoist the carrier along with the object that has been placed within the carrier using the hoisting mechanism (e.g., by running the hoisting mechanism (e.g., a rope) through a pulley and pulling the end of the rope that is not attached to the bail). In particular embodiments, the carrier is adapted to allow a user to hoist the carrier and any object placed within the carrier from a first height (e.g., ground level) to a second height that is greater than the first height. In other embodiments, the carrier is adapted to allow a user to lower an object from a second height (e.g., from the roof of a building) to a first height (e.g., ground level) where the first height is lower than the second height.

As may be understood by FIG. 6, when the user is hoisting the carrier with a contents-laden bucket disposed within the carrier, the carrier is configured to allow the user to hoist the carrier substantially smoothly (e.g., smoothly). This smooth hoisting may be accomplished, for example, because of the relative position of the load the carrier is bearing (e.g., within the carrier's frame) and the hoisting point of the hoisting mechanism adjacent an apex of the carrier's bail. In various embodiments, the weight of the carrier's load is sufficient to substantially prevent swinging or tipping of the carrier while the user is hoisting the carrier. In particular embodiments, this feature may minimize (e.g., or prevent) the risk of objects being hoisted within the carrier from falling out or substantially shifting during hoisting.

In particular embodiments, the carrier is adapted for use in a construction site. In such embodiments, the carrier's frame may be made of a material such as steel that is sufficiently strong to support fully loaded buckets (e.g., a bucket full of cement or similar heavy material or objects such as tools, construction debris, etc.). The carrier may be utilized to hoist objects at a construction site to elevated working areas (e.g., working areas supported by scaffolding). The carrier may be further utilized to lower objects (e.g., construction debris, tools, or other objects) from an elevated area to ground level.

In various embodiments, the carrier is adapted to be sufficiently structurally strong to enable a user to safely hoist a relatively heavy load (e.g., to hoist the load without a substantial risk of the carrier breaking or failing and causing the load and/or the carrier to fall or drop during hoisting). In a particular embodiment, the carrier is adapted to have sufficient structural strength to at least fully support and hoist a standard sized bucket (e.g., a five gallon pail) full of concrete, which may, for example, weigh between about 85 and about 100 pounds. In various embodiments, the carrier is configured to at least fully support and hoist any amount of weight of material that may require hoisting (e.g., may require hoisting at a construction site). This may include, for example, loads up to about 200 pounds, loads up to about 500 pounds, loads up to about 1000 pounds, etc.).

Conclusion

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation.

I claim:

1. A carrier comprising:

a frame comprising a base, at least one vertical support comprising four vertical supports, and an upper portion, said frame defining an opening adjacent said upper portion that is sized to accommodate a substantially bucket-shaped object; and a bail that is affixed adjacent said upper portion, wherein:

said carrier is configured to allow a user to selectively place said substantially bucket-shaped object substantially within said carrier;

said base is configured to at least partially support said substantially bucket-shaped object when said substantially bucket-shaped object is substantially within said carrier;

said four vertical supports are substantially evenly spaced about a circumference of said frame, extend between said base and said upper potion, and are substantially perpendicular to a plane of said base;

said upper portion of said frame, said opening defined adjacent said upper portion, and said base of said frame are substantially circular;

at least one of said four vertical supports is substantially V-shaped; and said carrier is configured to allow said user to hoist said carrier and said substantially bucket-shaped object from a first height to a second height.

2. A carrier comprising:

a frame comprising a base comprising at least one lower support, at least one vertical support, and an upper portion, said frame defining an opening adjacent said upper portion that is sized to accommodate a substantially bucket-shaped object; and a bail that is affixed adjacent said upper portion, wherein:

said carrier is configured to allow a user to selectively place said substantially bucket-shaped object substantially within said carrier;

said base is configured to at least partially support said substantially bucket-shaped object when said substantially bucket-shaped object is substantially within said carrier;

said upper portion of said frame, said opening defined adjacent said upper portion, and said base of said frame are substantially circular; said at least one lower support extends between a first portion adjacent an outer portion of a circumference of said base and a second portion adjacent said outer portion of said circumference of said base;

and said at least one lower support comprises two lower supports;

said two lower supports are substantially parallel to one another;

said two lower supports are each substantially V-shaped; and said carrier is configured to allow said user to hoist said carrier and said substantially bucket-shaped object from a first height to a second height.

3. A carrier for hoisting a substantially bucket-shaped object comprising:

a substantially cylindrical frame comprising:

a substantially circular base comprising one or more lower supports defining a support surface for said substantially bucket-shaped object;

a substantially circular upper portion;

a plurality of vertical supports that extend between said base and said upper portion, said plurality of vertical supports being substantially parallel to one another and disposed substantially evenly about a circumference of said base and said upper portion; and a bail having a first end and a second end, wherein:

said first end is disposed adjacent said upper portion; and said second end is disposed adjacent said upper portion in a location substantially diametrically opposed about said circumference of said upper portion from a location in which said first end is disposed, wherein:

said carrier is configured to enable a user to hoist said substantially bucket-shaped object from a first height to a second height by affixing a hoisting mechanism to said bail;

said carrier is configured to maintain said substantially bucket-shaped object within said frame while said user is hoisting said carrier; and said lower supports and said vertical supports are substantially V-shaped.

* * * * *